US006105376A

United States Patent [19]

Stewart et al.

[11] Patent Number: 6,105,376

[45] Date of Patent: Aug. 22, 2000

[54] VALVE AND VANE STRUCTURES FOR WATER COOLING AIR CONDITIONER HEAT EXCHANGER FINS

[76] Inventors: Peter B. Stewart, 3717 Stratford, Dallas, Tex. 75205; Brian Abramson, 365 Kennedy Road, Brampton, Ontario, Canada, L6W 3H3

[21] Appl. No.: 09/296,712

[22] Filed: Apr. 9, 1999

[51] Int. Cl.[7] ..... F28D 3/00

[52] U.S. Cl. ..... 62/171; 62/183; 62/305; 62/506

[58] Field of Search ..... 62/183, 181, 171, 62/305, 506

[56] References Cited

U.S. PATENT DOCUMENTS

| | | | |
|---|---|---|---|
| 3,872,684 | 3/1975 | Scott . | |
| 4,193,269 | 3/1980 | Barry | 62/171 |
| 4,274,266 | 6/1981 | Shires . | |
| 4,542,627 | 9/1985 | Welker . | |
| 4,685,308 | 8/1987 | Welker et al. . | |
| 5,074,124 | 12/1991 | Chapman . | |
| 5,117,644 | 6/1992 | Fought . | |
| 5,285,651 | 2/1994 | Marine | 62/171 |
| 5,311,747 | 5/1994 | Pringle et al. | 62/183 |
| 5,418,147 | 5/1995 | Cooper . | |

*Primary Examiner*—Henry Bennett
*Assistant Examiner*—Marc Norman
*Attorney, Agent, or Firm*—Marks & Clerk

[57] ABSTRACT

A mechanical control apparatus is provided for controlling the spray or misting of water into the immediate vicinity of the condenser coils in the compressor unit of an air conditioner, and comprises a hinged, vaned paddle member; and a water valve mechanically connected to and operable by the paddle member. The paddle member is mounted so that blown air flow from an air fan in the compressor unit will impinge on the paddle member, will and cause it to pivot upwardly about a hinge. The paddle member has a mechanical valve operating member, and is connected to a source of pressurized water, so that when the valve is open, water will pass through it to at least one nozzle mounted on the compressor unit to be sprayed or misted into the immediate vicinity of the condenser coils. The mechanical linkage between the paddle member and the valve is such that when the paddle member is pivoted upwardly, the valve will be opened; and when the paddle member is in its horizontal orientation, the valve will be closed. The hinged paddle member has a first half region which is distal with respect to the hinge, and a second half region which is proximal the hinge; and there are a plurality of vane elements which are spaced away from each other. The vane elements which are in the first half region are each sloped upwardly and in a direction towards the hinge, and the vane elements which are in the second half region are each sloped upwardly and in a direction away from the hinge.

15 Claims, 3 Drawing Sheets

VALVE AND VANE STRUCTURES FOR WATER COOLING AIR CONDITIONER HEAT EXCHANGER FINS

FIELD OF THE INVENTION

This invention relates to air conditioners; and in particular, this invention relates to an apparatus for controlling the delivery of cooling water into the immediate vicinity of the condenser coils of an air conditioner so as to promote faster heat exchange therefrom. In that regard, the present invention is directed to a mechanical control apparatus which may be easily and inexpensively installed on an air conditioner, and which requires no electrical connections.

BACKGROUND OF THE INVENTION

There are a number of different types of air conditioners; the field in which the present invention is found is that which is directed to refrigerator-type air conditioners which are installed in residential homes, or perhaps small office or industrial buildings.

In general, refrigerator-type air conditioners comprise either wall-mounted or window-mounted units of the sort commonly referred to as room air conditioners, and air conditioners which are intended for use with central heating and air conditioning systems. Those air conditioner units have a much higher capacity than room air conditioners, and generally comprise two principal elements. The first element is a heat exchanger which is mounted in a plenum chamber of a central forced air furnace, or which is otherwise mounted into an air duct from which air is distributed into the building to be cooled, and a compressor unit which is usually mounted on brackets off the side of the building or on such as a concrete pad located beside the building.

The compressor unit, in fact, comprises a refrigeration unit having a compressor, condenser coils, and so on. The condenser coils may have fins connected to them, or they may be mounted in a complicated labyrinthine configuration; and in any event, the design provision is for there to be very considerable surface on the condenser coils and/or associated fins so as to radiate heat into the atmosphere as quickly as possible. To promote the heat radiation away from the condenser coils, a fan is mounted within the compressor unit to blow air past the condenser coils.

However, if the capacity of the air conditioner is somewhat undersized for the building which is intended to be cooled, or if there is a very hot weather, or in any event when it is desired to improve the efficiency of the air conditioner, there may be an installation associated with the external compressor unit of the air conditioner, whereby water may be sprayed or misted into the immediate vicinity of the condenser coils of the air conditioner, so as to promote faster heat exchange from the condenser coils. This enhanced cooling of the condenser coils of an air conditioner may result in a few extra degrees of cooling for the building, or less load on the compressor; and that, in turn, may result in a more efficient air conditioner operation.

The present invention provides a simple and inexpensive apparatus for controlling the delivery of cooling water to the vicinity of the condenser coils of an air conditioner. However, the precise manner of delivery of water to the vicinity of the air conditioner condenser coils, the nozzles through which the water is sprayed, and the mounting arrangement for the nozzles, are all outside the scope of the present invention. What the present invention does provide is an apparatus which will open or close a water valve; and if the valve is open, water will be delivered to the spray nozzle or nozzles in any well known manner.

Moreover, it is assumed that, for purposes of the present invention, the water source from which the pressurized water is delivered will generally be ordinary household water which is delivered at ordinary household pressure. Therefore, the valve which comprises an essential element of the apparatus of the present invention may be a relatively simple structure, and the valve may assume any one of a number of different configurations. However, as will be discussed hereafter, it is also contemplated that, in certain circumstances, the pressure of the water delivered to the spray nozzles may be quite high—as much as 1,500 psi.

Most externally mounted compressor units for air conditioners of the sort found in homes or small office or industrial buildings, as described above, are such that the fan is mounted in a cabinet for the compressor unit, where the fan is mounted at the bottom of the cabinet and blows upwardly past the condenser coils. It is those air conditioner units with which the present invention is intended to be used, because a feature of the present invention is such that an upward flow of air is required to move a hinged, vaned paddle member so as to open a valve, all in a manner described hereafter. In any event, it will be noted that the hinged, vaned paddle member is such that it may be mounted to the top of an air conditioner compressor unit cabinet, in a horizontal orientation, and in a location where blown air flow from the fan in the air conditioner compressor unit will impinge on the paddle member and cause it to pivot upwardly in a manner described hereafter.

By providing a simple mechanical linkage to open a valve, the necessity for complicated, expensive, and potentially dangerous electrical installations, by which solenoid valves or the like would be opened to permit water spray over the condenser coils of the air conditioner unit, is obviated. Thus, the present invention provides a direct, mechanical linkage and does not rely on servomechanisms or the like.

Another aspect of the present invention is its purpose to provide a control apparatus for the delivery of cooling water to the compressor unit of an air conditioner, where the delivery of the water cooling is not directly into the condenser coils of the air conditioner, but into the vicinity of the condenser coils. More especially, the present invention may particularly be used with a spray nozzle system that is set up not to directly spray or impinge water onto the condenser coils, but to spray the water into the air so that it will become a fine mist in the volume of air surrounding the compressor unit. Indeed, the fine mist of water may evaporate so as to increase the humidity of the air in the immediate vicinity of the compressor unit and its condenser coils. This higher, very localized humidity, whether it is as a consequence of water mist or water vapor in the vicinity of the condenser coils, will result in a higher efficiency of cooling because there will be a higher rate of transfer of heat from the condenser coils to the more humid air than if the air were dry. Moreover, by having a fine mist, and especially when the water evaporates to become water vapor, there is much less likelihood that mineral deposits will occur on the condenser coils from the minerals that may have been dissolved in the water.

DESCRIPTION OF THE PRIOR ART

A water vapour cooling system for air cooled condenser coils is taught in SCOTT U.S. Pat. No. 3,872,684. Here, a solenoid valve is provided so as to direct only a regulated, metered amount of water to the upper surface of a lower portion of an air conditioner. The solenoid valve is thermostatically controlled; moreover, the solenoid valve is functional only when the compressor motor of the air conditioner is operating. The system taught in this patent is particularly adapted for use with unitary air conditioners of the sort which are generally wall- or window-mounted.

SHIRES U.S. Pat. No. 4,274,266 teaches another system for directing a water spray onto the condenser unit of an air cooled air conditioner. Here, the water spray is effected in response to the operation of an air actuated valve when the air conditioner is energized. The air actuated valve is disposed in the exhaust air stream of the motor driven fan which is used to create a cooling air flow through the condenser unit of the air conditioner. The air actuated valve is such as to permit the flow of water ultimately through a water manifold assembly to conduits and spray nozzles, so as to spray the water onto the condenser coils. The air actuated valve is actuated by an air operated paddle valve assembly which is mounted so as to accommodate swinging movement of the paddle from a normally valve closed attitude to a valve open attitude. The arc through which the paddle will swing is generally only a few degrees.

WELKER U.S. Pat. No. 4,542,627, and a continuation-in-part U.S. Pat. No. 4,685,308 issued to WELKER et al, each provide teachings of a very complicated valve structure which, however, is activated in the first instance by the flow of air from a cooling fan inside the air conditioner unit engaging a driver member which, in turn, will cause a control lever to move. The driver member is a substantially solid planar member, which is ordinarily engaged by a vertical current of air expelled from the air conditioner. The driver member is generally oriented to be essentially orthogonal to the force lines associated with the attraction of gravity; however, the driver member may be mounted in other orientations, including being mounted parallel to the force of gravity and then being spring actuated so as to return to a closed position. The fluid control device of WELKER et al requires a housing member in which the driver member is located; and a complicated linkage arrangement is found within that housing for the control lever of the valve.

U.S. Pat. No. 5,074,124 issued to CHAPMAN teaches another approach to increasing the efficiency of air conditioners, by providing a valve which actuates mist-spray heads only when the air conditioner fan is actuated. This draws air from the immediate vicinity of the air conditioner so as to pass that air over the condenser coils of the air conditioner, where the air has been cooled in the first instance by the mist spray of water.

FOUGHT U.S. Pat. No. 5,117,644 teaches a cooling device for air conditioner condensers which will deliver a spray mist to the coils of the condenser only when the condenser is operating. Here, a vibration transducer is provided to sense vibrations of the condenser when it is in operation. The transducer will then produce a signal to open a valve and thereby to supply fluid to a spray nozzle adjacent the condenser. When the condenser unit is off and is thus not vibrating, the valve closes and the spray operation is terminated.

COOPER U.S. Pat. No. 5,419,147 teaches an electrically actuated on-off valve which can be operatively connected to tubing from which water will be sprayed only when the compressor is operating.

In general, the prior art requires either a complicated mechanical installation, an electrical installation, or both. In contradistinction thereto, the present invention provides a control apparatus for air conditioner compressor units which is simple and inexpensive to install, and which—apart from the installation of spray nozzles, which is outside the scope of the present invention—may be installed in only a very short period of time to the cabinet of an air conditioner compressor unit.

SUMMARY OF THE INVENTION

The general principles of the present invention are embodied in an apparatus which is intended for mounting on a compressor unit of an air conditioner, where the compressor unit has a controlled air fan which is mounted therein to blow air past condenser coils of the air conditioner. Thus, the present invention provides an apparatus which is a mechanical control apparatus for controlling the spray or misting of water into the immediate vicinity of the condenser coils of the air conditioner so as to promote faster heat exchange therefrom. The apparatus comprises a hinged, vaned paddle member, and a water valve which is mechanically connected to and operable by the paddle member.

When the apparatus of the present invention is mounted on a compressor unit of an air conditioner, the hinged, vaned paddle member is mounted in a generally horizontal orientation, and in such a location that blown air flow from an air fan which is mounted in the compressor unit of the air conditioner will impinge on the paddle member so as to cause the paddle member to pivot upwardly about a hinge at one side thereof.

The paddle member has a valve operating member which is mechanically linked to it. The valve is connected to a source of pressurized water—usually, household water, as discussed above. Thus, when the valve is open, water will pass through the valve to at least one nozzle which is mounted on the compressor unit so as to be sprayed or misted into the immediate vicinity of the condenser coils of the compressor unit. The mechanical linkage between the paddle member and the valve is such that, when the paddle member is pivoted upwardly about the hinge when air impinges on the paddle member, the valve will be opened. Likewise, when the paddle member is in its horizontal orientation, the valve will be closed.

The hinged paddle member is configured so as to have a first half region and a second half region. The first half region is that region of the hinged paddle member which is distal with respect to the hinge—that is, the first half region is further away from the hinge. Likewise, the second half region is that region which is proximal—that is, nearest—the hinge.

Moreover, the hinged paddle member has a plurality of vane elements which are spaced away from each other. Still further, the vane elements are such that those which are in the first half region of the paddle member are each sloped upwardly and in a direction towards the hinge. The vane elements which are in the second half region of the paddle member arc each sloped upwardly, but in a direction away from the hinge.

The general configuration of the hinged, vaned paddle member is such that it is substantially planar. Moreover, in general, the paddle member has a circular configuration.

The vanes of the paddle member may be configured in two different manners, particularly when the paddle member has a generally circular configuration. In the first instance, each of the vane elements may be positioned so as to comprise a chord of the circle which defines the circular configuration. In that case, the vane elements are generally straight and parallel one to another.

On the other hand, in another configuration of circular paddle member in keeping with the present invention, each of the vane elements may also have a circular configuration. In that case, the plurality of vane elements are concentric with respect to each other.

A particular form of mechanical linkage between the paddle member and the valve is taught hereafter. That mechanical linkage comprises a camming surface on the paddle member in the region of the hinge, and a cam follower member which is operatively associated with the valve so as to cause the valve to open or close. The cam follower member is biased against the camming surface.

Thus, when the paddle member is pivoted upwardly about the hinge, the camming surface will cause the cam follower member to move against its bias and to open the valve. When the paddle is in its horizontal orientation, the bias of the cam follower member will cause the cam follower member to move against the camming surface, and the valve will be closed.

Generally, the slope of each of the vane elements, whether they comprise chords or are concentrically located circles, is between 40° and 50° with respect to the major plane of the paddle member. Typically, the slope of each of the vane elements is substantially 45°.

Likewise, the paddle member is arranged to pivot upwardly about its hinge through an arc of from 40° to 50° when blown air flow from the air fan mounted in the compressor unit of an air conditioner impinges on the vane elements. Typically, the arc through which the paddle member will pivot is substantially 45°.

The paddle member may conveniently be formed from a plastics material, or it may be formed of aluminum or other suitable metal.

An object of the present invention, therefore, is to provide a mechanical control apparatus for controlling the spray or misting of water into the immediate vicinity of the condenser coils of an air conditioner, which apparatus is inexpensive, and is simple to install.

It follows from the above that a further object of the present invention is to provide such an apparatus as described above, which does not rely on expensive and/or potentially dangerous electrical connections; and in any event, does not require the use of servomechanisms or the like.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS:

Reference will now be made to FIGS. 1 through 9.

Figure 8:
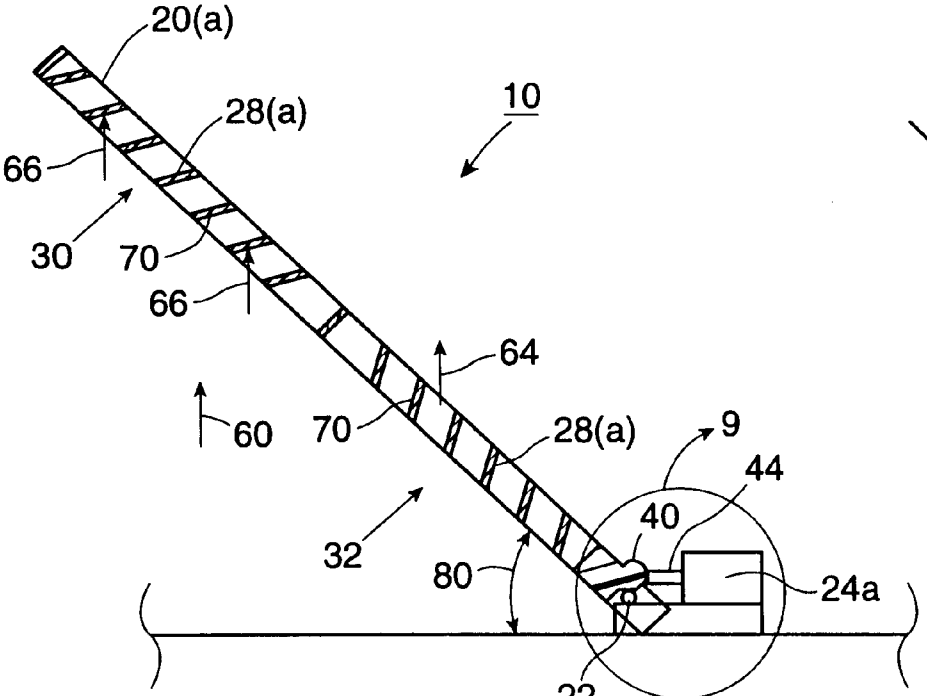
FIG. 8 is a partial sectional view of a paddle element in keeping with the present invention when in its upwardly pivoted orientation.

Turning first to FIGS. 1 through 4, an apparatus in keeping with the present invention is shown generally at 10. An apparatus 10 in keeping with the present invention is also shown in FIG. 8. The apparatus 10 is mounted on a typical compressor unit 12 of an air conditioner. It will be understood that within the cabinet of the compressor unit 12 there will be mounted an air fan and a plurality of condenser coils. The air fan will generally be located at the bottom of the compressor unit 12, and will be oriented so as to blow air upwardly. The air fan in the compressor unit 12 will be controlled, as is always the case with refrigerator-type air conditioner units, so that the fan will blow only when the compressor is operating and air cooling of the condenser coils of the air conditioner unit is required.

No piping for the air conditioner unit is shown, it being understood that the air conditioner unit will have been installed in the first instance by a qualified air conditioner or heating, ventilating, and air conditioning mechanic. Likewise, no water supply to the valve is shown, it being understood that, in general, a simple water conduit or even a typical hose may be utilized. In any event, the installation of the water conduit or hose, and indeed the installation of water spray nozzles, are outside the scope of the present invention but are clearly within the ability of almost any handyman—anyone who is adept in the use of simple tools and is capable of reading simple instructions. Indeed, the spray nozzles may be mounted on nozzle stands that are spaced away from the compressor unit 12, so as to ensure that it is the air in the vicinity of the compressor unit into which the water is sprayed or misted.

A principal component of the apparatus of the present invention is a hinged, vaned paddle member 20, which may have differing configurations as to the vane elements that are mounted in the paddle member. These matters are discussed hereafter.

The hinged, vaned paddle member 20 has a hinge 22 at one side thereof. Moreover, the hinged, vaned paddle member 20 is mechanically connected to a water valve 24, such that the water valve is operable by the paddle member 20 as described in greater detail hereafter.

Figure 1:
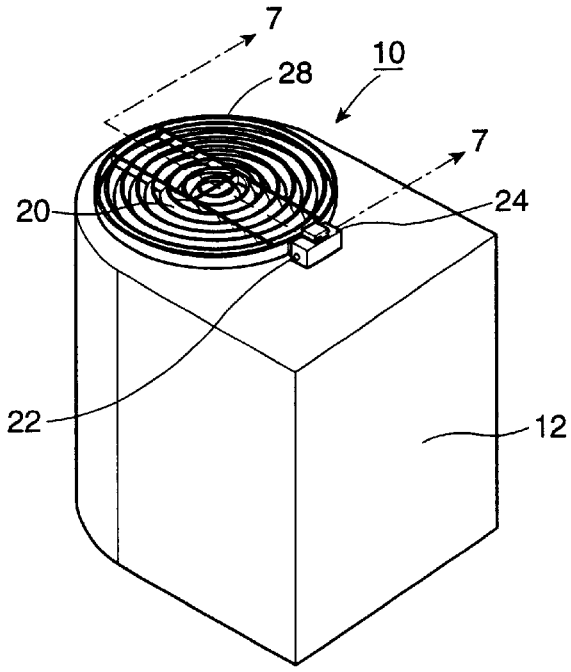
FIG. 1 is a perspective view of a typical compressor unit of an air conditioner, having apparatus in keeping with the present invention installed thereon.
Figure 2:
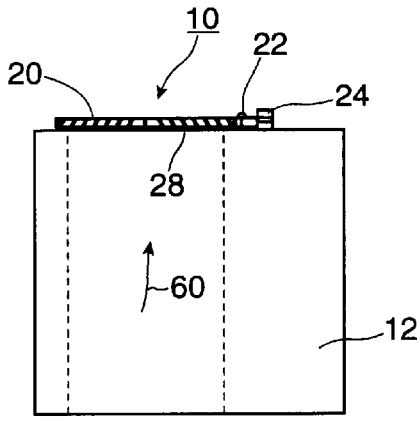
FIG. 2 is a side elevation of FIG. 1.

As can be seen particularly from FIGS. 1 and 2, the paddle member 20 is mounted in a generally horizontal orientation on the compressor unit 12 of an air conditioner. Moreover, as can be seen, and as will be described hereafter, the location where the paddle member 20 is located is such that blown air flow from the air fan which is mounted in the compressor unit 20 will impinge on the paddle member 20, and cause it to pivot upwardly about the hinge 22, as described hereafter.

In general, the paddle member 20 has a valve operating member which is mechanically linked thereto. A specific valve operating member is described hereafter, particularly in association with FIGS. 8 and 9, but it will be understood that any mechanical valve operating member may be used, provided that it may be linked to the paddle member so as to cause the valve 24 to open and close depending on whether the paddle member is in its upwardly pivoted orientation or its horizontal orientation. For example, the mechanical linkage may be as simple as a device associated with the paddle member 20 which pinches a tube when the paddle member is in its horizontal orientation, but which permits the tube to open when the paddle member 20 is pivoted upwardly. Likewise, a simple globe valve, stop cock valve, or any other valve structure which will go from a valve-closed condition to a valve-open condition upon rotational movement of a valve operating member through approximately 45°, may be mechanically linked to the paddle member 20 in the region of the hinge 22.

Figure 3:
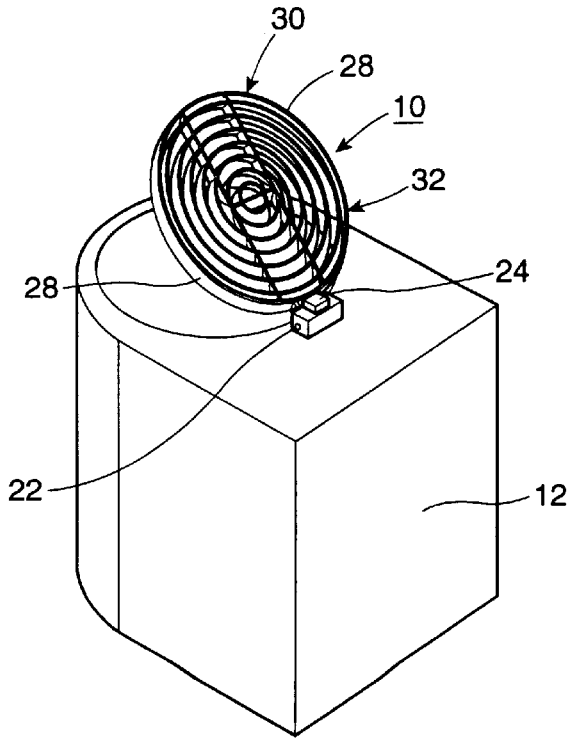
FIG. 3 is a view similar to FIG. 1 but with the paddle member being pivoted upwardly to its operating position.
Figure 4:
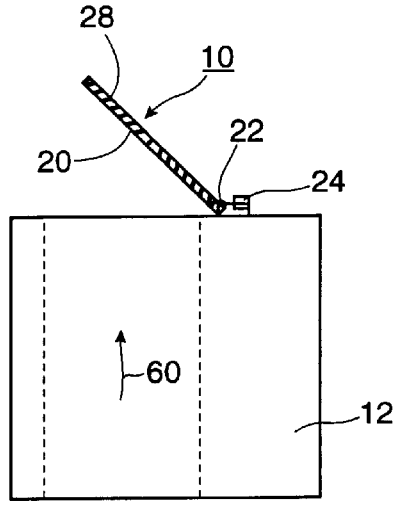
FIG. 4 is a side elevation of FIG. 3.

In any event, when the mechanical linkage between the paddle member 20 and the valve 24 is such that the valve is open, and when the valve is connected to a source of pressurized water, then water will pass through the valve 24 to at least one nozzle (not shown) mounted on the compressor unit 12 so as to be sprayed or misted into the immediate vicinity of the condenser coils of the compressor unit 12. Thus, the mechanical linkage between the paddle member 20 and the valve 22 is such that when the paddle member 20 is pivoted upwardly about the hinge 22 when blown air flow impinges on the paddle member as shown in FIGS. 3 and 4, the valve 24 will be opened; and when the paddle member is in its horizontal orientation as shown in FIGS. 1 and 2, the valve 24 will be closed.

The hinged paddle member 20 has two half regions. Referring to FIG. 3, for ease of reference, the first half region 30 is that region which is distal with respect to the hinge 22; and the second half region 32 is proximal the hinge 22.

Figure 5:
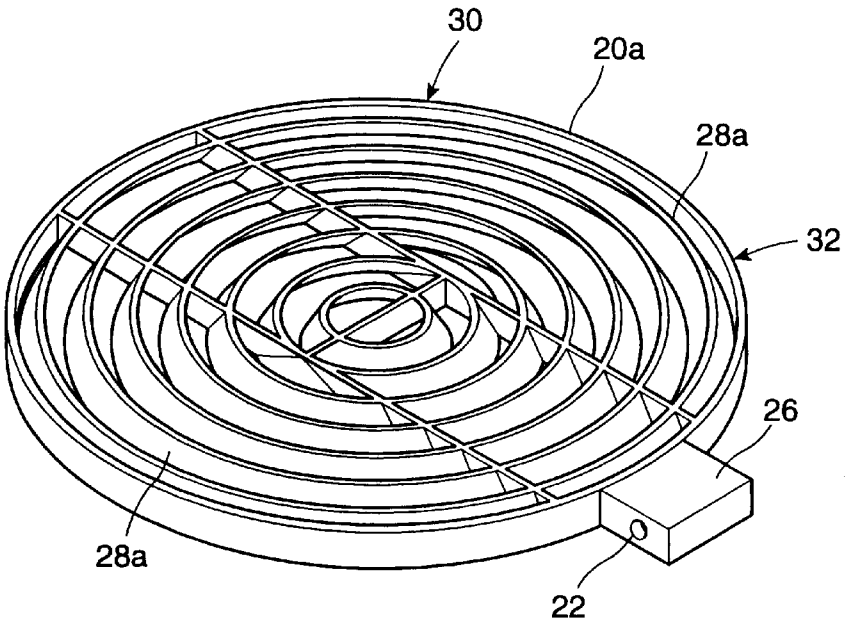
FIG. 5 is a perspective view of a second embodiment of vane elements of a paddle member in keeping with the present invention.

Likewise, assuming that the hinge 22 is located in a general hinge structure 26, as shown in FIG. 5, the first and second half regions 30, 32 of that paddle member 20*a* are also those which are distal and proximal, respectively, to the hinge 22.

The paddle members 20 and 20*a* each have a plurality of vane elements 28 or 28*a*. Each of the vane elements 28 or 28*a* is spaced away from each other vane element 28 or 28*a*, as can be clearly seen from any of FIGS. 1 through 8.

Figure 7:
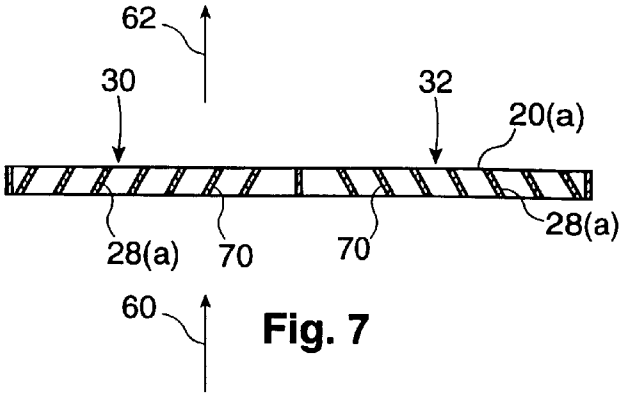
FIG. 7 is a cross-section of the vane elements of paddle member in keeping with the present invention, taken in the direction of arrow 7—7 in either of FIGS. 1 or 6.
Figure 6:
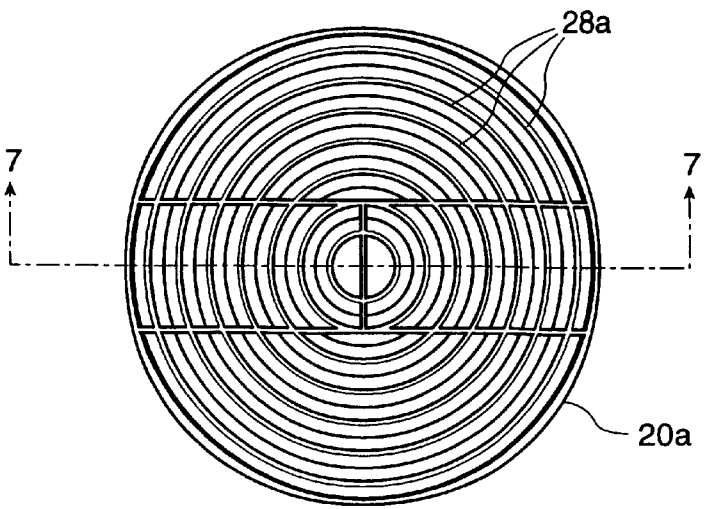
FIG. 6 is a plan view of the vane element configuration of FIG. 5.

An examination of FIGS. 1 and 6, for example, will reveal that the cross-section of a paddle member which is shown in FIG. 7 may just as easily be a cross-section of the paddle member 20 of FIGS. 1 through 4, or the paddle member 20*a* of FIGS. 5 and 6. Thus, the paddle member is designated 20(*a*) in each of FIGS. 7 and 8—which also shows a cross-section of a paddle member.

In any event, it will be clearly understood and noted from any of FIGS. 1 through 4, 5, 7, and 8, that the vane elements 28 or 28*a* which are in the first half region 30 of the paddle member 20 or 20*a* are each sloped upwardly and in a direction towards the hinge—that is, upwardly and to the right as seen, for example, in FIGS. 2 and 7. Likewise, the vane elements 28 or 28*a* which are in the second half region 32 of the paddle member 20 or 20*a* are each sloped upwardly and in a direction away from the hinge—also, as seen for example in FIGS. 2 and 7, upwardly and to the left.

Briefly, it will be noted from any of FIGS. 1 though 9 that the paddle member 20 or 20*a* is substantially planar. Moreover, the paddle member 20 or 20*a* will have a generally circular configuration, as noted in any of FIGS. 1, 3, 4, and 6; however, other configurations may also be used. The circular configuration as shown is the most usual configuration, since the arrangement of the condenser coils in a compressor until 2, installed in a cabinet, is generally circular.

As already noted, the vane elements 28 in the paddle member 20, as shown in FIGS. 1 and 3, may comprise a plurality of chords of the circle which defines the circular configuration of the paddle member 20. Likewise, as shown particularly in FIGS. 5 and 6, the vane elements 28*a* may each have a circular configuration, so that the plurality of vane elements 28*a* are concentric with respect to each other.

Figure 9:
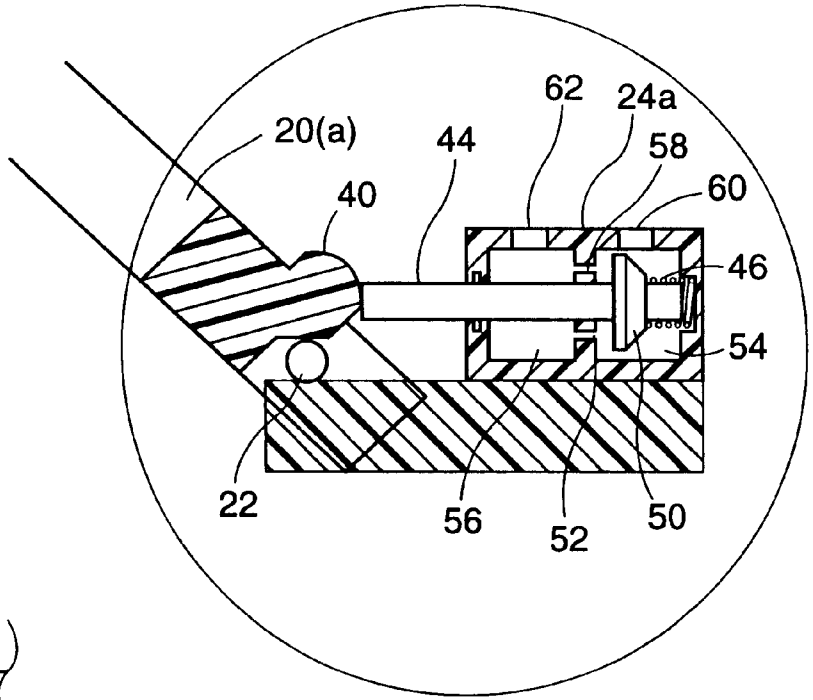
FIG. 9 is a cross-section to a larger scale of that portion of FIG. 8 shown in circle 9, being a typical valve structure which may be employed with the present invention.

A particular mechanical linkage between the paddle member 20 or 20*a*, and a specific valve 24*a*, is shown in FIGS. 8 and 9. Here, the mechanical linkage comprises a camming surface 40 which is formed on the paddle member 20 or 20*a* in the region of the hinge 22. A cam follower member 44 is operatively associated with the valve 24*a* so as to cause the valve to open or close. In this embodiment, described hereafter, the cam follower 44 is biased against the camming surface 40, by a biasing spring 46. Thus, as will be clearly understood from an examination of FIGS. 8 and 9, when the paddle member 20 or 20*a* is pivoted upwardly about the hinge 22, as shown in each of FIGS. 8 and 9, the camming surface 40 will cause the cam follower member 44 to move against its bias—the bias spring 46—and to open the valve. In the particular valve 24*a* which is detailed in FIG. 9, it will be seen that a valve member 50 is moved away from valve face 52, thereby permitting flow of water from the chamber 54 which is on the upstream side of the valve member 50 through passages 58 to the chamber 56. Of course, it will be understood that the chamber 54 of valve 24*a* is connected to a source of pressurized water through its inlet 60; and when the valve 24*a* is in its open condition as shown in FIG. 9, water will flow from the valve 24*a* through the outlet 62.

Likewise, when the paddle member 20 or 20*a* assumes its horizontal orientation, it will be seen that the bias of the cam follower member 44 will cause it to move against the camming surface 40, and thus the valve 24*a* will be closed as the face of the valve member 50 contacts the valve face 52.

Referring particularly to FIGS. 7 and 8, but with reference also to FIGS. 2 and 4, the operation of the hinged, vaned paddle member 20 or 20*a* when blown air flow impinges upon it will now be described. It has been noted above that the direction of air flow from the air fan in the compressor unit 12 is upwardly, in the direction of arrow 60 as shown in each of FIGS. 2, 4, 7, and 8, for ease of understanding. When the paddle 20 or 20*a* is in its horizontal orientation, it will be seen particularly from FIG. 7, that air flow will impinge on the undersurfaces 70—that is, the surfaces which face downwardly—of each of the vane elements 28 or 28*a*. However, as the air flow develops and continues, there will be a lifting force created against the paddle member 20 or 20*a*, as shown by arrow 62 in FIG. 7. That lifting force will, in turn, continue to keep pushing against the undersurfaces 70 of the vanes 28 or 28*a*, causing the paddle member 20 or 20*a* to begin to pivot upwardly about the hinge 22. Obviously, as the paddle member 20 or 20*a* continues to pivot upwardly about the hinge 22, so as to assume a position such as that shown in FIGS. 4 and 8, the air flow will flow past the vanes 28 or 28*a* in the second half region of the paddle element 20 or 20*a*, as shown at arrow 64 in FIG. 8. However, the same air flow will then be directed substantially perpendicularly against the undersurfaces 70 of the vanes 28 or 28*a* in the first half region 30 of the paddle member 20 or 20*a* . This is shown by arrows 66 in FIG. 8.

Moreover, it will also be appreciated that the force of the air against the undersurfaces 70 of the vane elements 28 or

28*a* when the paddle member 20 or 20*a* is in its upwardly pivoted orientation, will be such that there is a mechanical advantage derived from the force of the air flow as shown by arrow 66, with respect to the hinge 22, so as to thereby assure that the paddle member 20 or 20*a* maintains its upwardly pivoted orientation for so long as blown air flow impinges against it.

Accordingly, it will be understood that the design of the vane elements 28 or 28*a* in the respective paddle members 20 or 20*a* will be such that the slope of each of the vane elements 28 or 28*a* will be between 40° and 50° with respect to the major plane of the respective paddle member—the major plane being represented, for example, by either the top or bottom surface of the respective paddle member.

Of course, the particular configuration of paddle members 20 or 20*a*, in keeping with the present invention, is such that the slope of the vane elements 28 or 28*a* will be substantially 45° with respect to the major plane of the paddle member.

Likewise, it will be seen that the arc through which the paddle member 20 or 20*a* will pivot upwardly about the hinge 22—as shown by arrow 80 in FIG. 8—will generally be in the range of from 40° to 50° when blown air flow from the air fan mounted in the compressor unit 12 of an air conditioner impinges on the vane elements 28 or 28*a* of the paddle member 20 or 20*a*. Again, typically that arc is substantially 45°.

However, if the paddle member 20 or 20*a* is designed so as to pivot only through an arc of 40°, then typically the angle at which the vane elements 28 or 28*a* are sloped will typically be 50° so as to permit an orthogonal impact of air flow against the vane elements in the first half region of the paddle member 20 or 20*a*, as demonstrated by arrows 66 in FIG. 8.

Obviously, when the flow of air in the direction of arrows 60 stops, after the controlled fan in the compressor unit 12 of the air conditioner has stopped, the force of gravity will cause the paddle member 20 or 20*a* to fall downwardly so as to assume its horizontal orientation. Of course, the valve will close; but it is understood that since the air fan has stopped its operation, there is no longer a requirement for enhanced heat exchange on the condenser coils of the air conditioner, which enhanced heat exchange comes as a consequence of water being sprayed or misted into the immediate vicinity of the condenser coils.

Finally, it will be understood that the materials from which the paddle member 20 or 20*a* is manufactured must be such that they will withstand the rigours of exposure to weather. This may be especially true in Northern climates, where hot summers require the use of an air conditioner, but where snow may fall on the compressor unit 12 of an air conditioner—it being generally understood that most people do not cover their externally mounted compressor units of their air conditioners during the winter.

Moreover, the material from which the paddle member 20 or 20*a* is formed must be relatively lightweight, durable, and inexpensive. Many plastics materials such as rigid polyurethane, rigid vinyl, polyvinyl chloride, and so on, may meet those criteria, and may be easily molded. Indeed, if a plastics material is used, the paddle member 20 or 20*a* may be vacuumed formed, injection molded, or manufactured using other plastics molding techniques. Likewise, the paddle member 20 or 20*a* may be formed from aluminum—which may be stamped, die-cast, machined, or otherwise manufactured using conventional techniques—and which may then be anodized for purposes of appearance and to preclude the development of aluminum oxide on the surfaces thereof. Stamped steel or other appropriate metals may also be used, but they require to be coated so as to protect the steel or other metal from oxidizing or otherwise being affected by the ambient weather.

While, in general, the present invention is directed to use with a source of water which is at ordinary household water pressure of from, say, 50 psi to 120 psi, it will be appreciated that a simple valve arrangement may also be provided for water which may be at a pressure of as much as 1,500 psi. For example, especially for large capacity air conditioner compressor units, water may first be allowed to flow to a reservoir, from which it will be pumped at pressures of up to 1,500 psi. The valve which is associated with the present invention may be on the low pressure side of the reservoir, or it may be located at the high pressure side of the reservoir. In either case, the structure of the paddle-operated valve may be very simple.

There has been described an apparatus which may be mounted on a compressor unit of an air conditioner, which apparatus provides a mechanical control to permit the spray or misting of water into the immediate vicinity of the condenser coils of the air conditioners, and which apparatus is a simple structure requiring a hinged, vaned paddle member which is directly mechanically linked to a valve. Several variations of structure of the hinged, vaned paddle member in keeping with the present invention have been described above; it has also been noted that a variety of water valves may be utilized, and that the precise structure of a water valve is outside the scope of the present invention provided that it may be operable from a closed to an open position as the paddle member is moved from its horizontal to its upwardly pivoted orientation.

Other variations and embodiments of the present invention may be provided without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially 45° is intended to mean that the defined angle is more or less 45° but not necessarily precisely 45°. Further, the word "generally" when used with an adjective or adverb is intended to enhance the scope of the particular characteristic; e.g. generally circular is intended to mean being circular or having the characteristics of circularity.

What is claimed is:

1. An apparatus for mounting on a compressor unit of an air conditioner, where the compressor unit has a controlled air fan mounted therein to move air past condenser coils of the air conditioner, said apparatus being a mechanical control apparatus for controlling the spray or misting of water into the immediate vicinity of the condenser coils of the air conditioner so as to promote faster heat exchange therefrom, said apparatus comprising:

a hinged, vaned paddle member; and a water valve mechanically connected to and operable by said paddle member;

wherein said hinged, vaned paddle member may be mounted in a generally horizontal orientation on a compressor unit of an air conditioner in such a location that blown air flow from an air fan mounted in the compressor unit will impinge on said paddle member, so as to cause said paddle member to pivot upwardly about a hinge at one side thereof;

wherein said paddle member has a valve operating member mechanically linked thereto, and said valve is connected to a source of pressurized water, whereby when said valve is open, water will pass through said valve to at least one nozzle mounted on said compressor unit so as to be sprayed or misted into the immediate vicinity of the condenser coils of said compressor unit; and wherein the mechanical linkage between said paddle member and said valve is such that when said paddle member is pivoted upwardly about said hinge when blown air flow impinges on said paddle member, said valve will be opened, and when said paddle member is in its horizontal orientation, said valve will be closed;

wherein said hinged paddle member has a first half region and a second half region thereof, where said first half region is that region which is distal with respect to said hinge, and said second half region is proximal said hinge; and wherein said hinged paddle member has a plurality of vane elements which are spaced away from each other;

wherein the vane elements which are in said first half region of said paddle member are each sloped upwardly and in a direction towards said hinge, and the vane elements which are in said second half region of said paddle member are each sloped upwardly and in a direction away from said hinge.

2. The apparatus of claim 1, wherein said paddle member is substantially planar, and has a generally circular configuration.

3. The apparatus of claim 2, wherein each of said vane elements comprises a chord of said circular configuration.

4. The apparatus of claim 2, wherein each of said vane elements has a circular configuration, and said plurality of vane elements are concentric with respect to each other.

5. The apparatus of claim 1, wherein the mechanical linkage between said paddle member and said valve comprises a camming surface on said paddle member in the region of said hinge, and a cam follower member operatively associated with said valve so as to cause said valve to open or close, wherein said cam follower is biased against said camming surface;

whereby when said paddle member is pivoted upwardly about said hinge, said camming surface causes said cam follower member to move against its bias and to open said valve, and when said paddle is in its horizontal orientation, the bias of said cam follower member causes said cam follower member to move against said camming surface and to close said valve.

6. The apparatus of claim 3, wherein the slope of each of said vane elements is between 40° and 50° with respect to the major plane of said paddle member.

7. The apparatus of claim 4, wherein the slope of each of said vane elements is between 40° and 50° with respect to the major plane of said paddle member.

8. The apparatus of claim 6, wherein said paddle member is arranged to pivot upwardly about said hinge through an arc of from 40° to 50° when blown air flow from an air fan mounted in compressor unit of an air conditioner impinges on said vane elements.

9. The apparatus of claim 7, wherein said paddle member is arranged to pivot upwardly about said hinge through an arc of from 40° to 50° when blown air flow from an air fan mounted in compressor unit of an air conditioner impinges on said vane elements.

10. The apparatus of claim 3, wherein the slope of each of said vane elements is substantially 45° with respect to the major plane of said paddle member.

11.The apparatus of claim 4, wherein the slope of each of said vane elements is substantially 45° with respect to the major plane of said paddle member.

12. The apparatus of claim 10, wherein said paddle member is arranged to pivot upwardly about said hinge through an arc of substantially 45° when blown air flow from an air fan mounted in thee compressor unit of an air conditioner impinges on said vane elements.

13. The apparatus of claim 11, wherein said paddle member is arranged to pivot upwardly about said hinge through an arc of substantially 45° when blown air flow from an air fan mounted in the compressor unit of an air conditioner impinges on said vane elements.

14. The apparatus of claim 1, wherein said paddle member is formed of a plastics material.

15. The apparatus of claim 1, wherein said paddle member is formed of a metal chosen from the group consisting of aluminum and steel.

* * * * *